US005782465A

United States Patent [19]

Rawlings et al.

[11] Patent Number: 5,782,465

[45] Date of Patent: Jul. 21, 1998

[54] SPEAR MISSED OPEN DETECTION SYSTEM

[75] Inventors: Greg Rawlings, Madison; Lonnie Worthington, Topeka, both of Kans.

[73] Assignee: Kansa Corporation, Emporia, Kans.

[21] Appl. No.: 549,044

[22] Filed: Oct. 27, 1995

[51] Int. Cl.[6] ..... B65H 39/00

[52] U.S. Cl. ..... 270/52.23

[58] Field of Search ..... 270/52.19, 52.21, 270/52.22, 52.23, 52.25

[56] References Cited

U.S. PATENT DOCUMENTS

| | | | |
|---|---|---|---|
| 3,561,751 | 2/1971 | Dutro . | |
| 3,656,738 | 4/1972 | Glaser et al. . | |
| 4,526,356 | 7/1985 | Swint . | |
| 4,754,959 | 7/1988 | Kobler et al. | 270/52.19 X |
| 5,279,495 | 1/1994 | Rello | 270/52.19 |
| 5,441,245 | 8/1995 | Fluckiger | 270/53.23 |
| 5,443,250 | 8/1995 | Gosslinghoff | 270/52.23 |

*Primary Examiner*—Hoang Nguyen
*Attorney, Agent, or Firm*—Hovey, Williams, Timmons & Collins

[57] ABSTRACT

A mechanism for opening a publication and for sensing the open or closed condition of the publication includes an opening mechanism for opening the publication into two sections, a first detector assembly for sensing the presence of one of the sections at a first location, and a second detector assembly for sensing the presence of the remaining section at a second location spaced from the first. An indicator responds to the first and second detector assemblies for indicating that the opening mechanism properly opened the publication when the sections are sensed at both the first and second locations, and for indicating that the opening mechanism missed opening the publication when the sections are sensed at only one of the first and second predetermined locations. Preferably, a piece of reflective tape is positioned at the first and second locations, and each detector assembly emits light that is directed onto the corresponding tape along a predetermined line that is angled 15°–45° relative to the tape. The light reflected back along the predetermined lines by the tape is directed back to the detector assemblies. The opening mechanism preferably includes a spear for piercing the publication, and an air outlet orifice for directing air under pressure across the spear toward the publication in a direction angled relative to the travel path of the publication to separate the sheets from one another immediately upstream of the spear, facilitating opening of the publication by the spear.

7 Claims, 3 Drawing Sheets

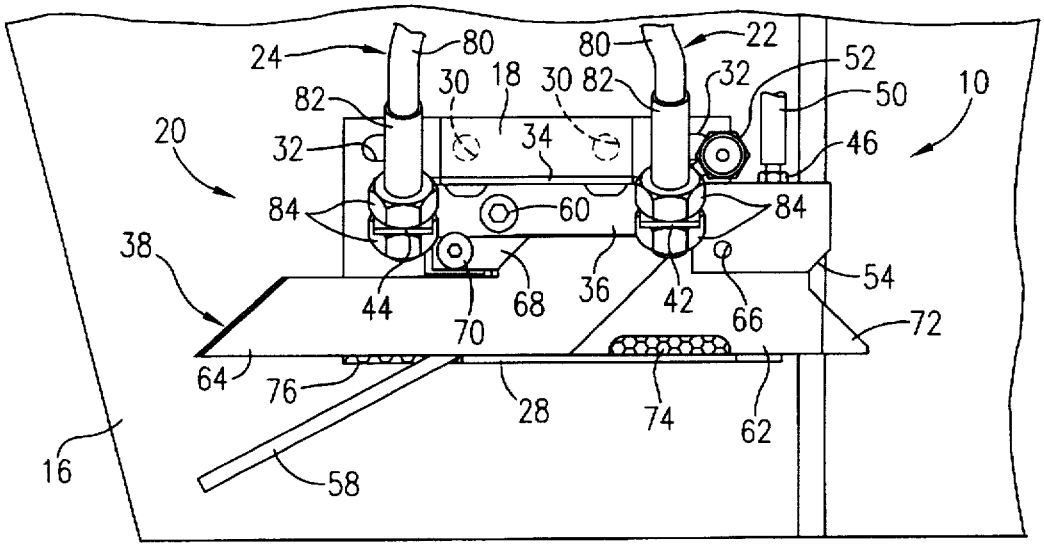
FIG. 2.
FIG. 3.
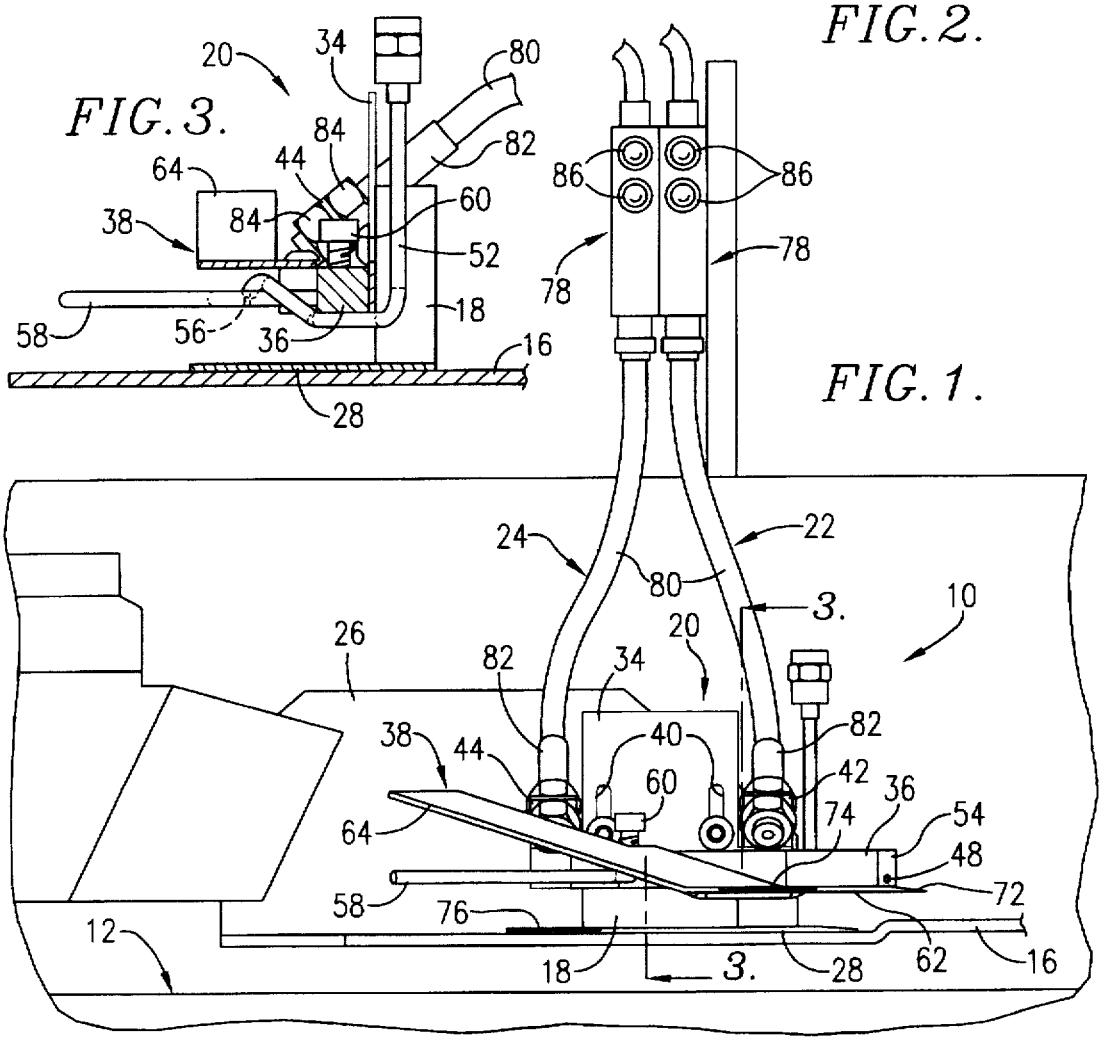
FIG. 1.

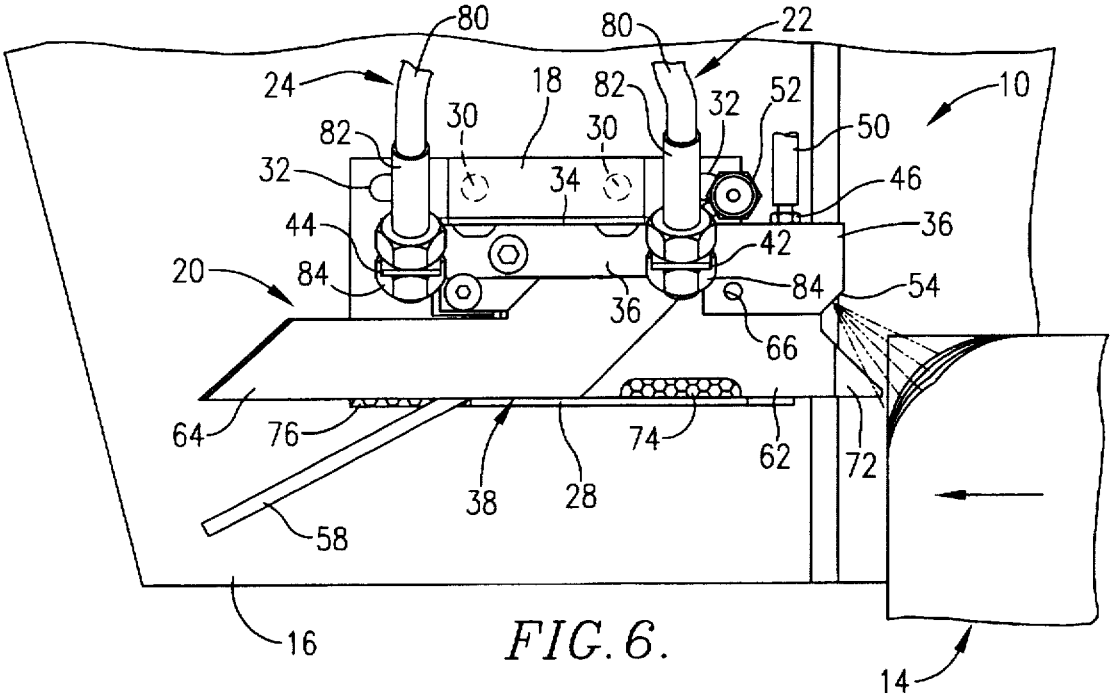
FIG. 6.
FIG. 7.
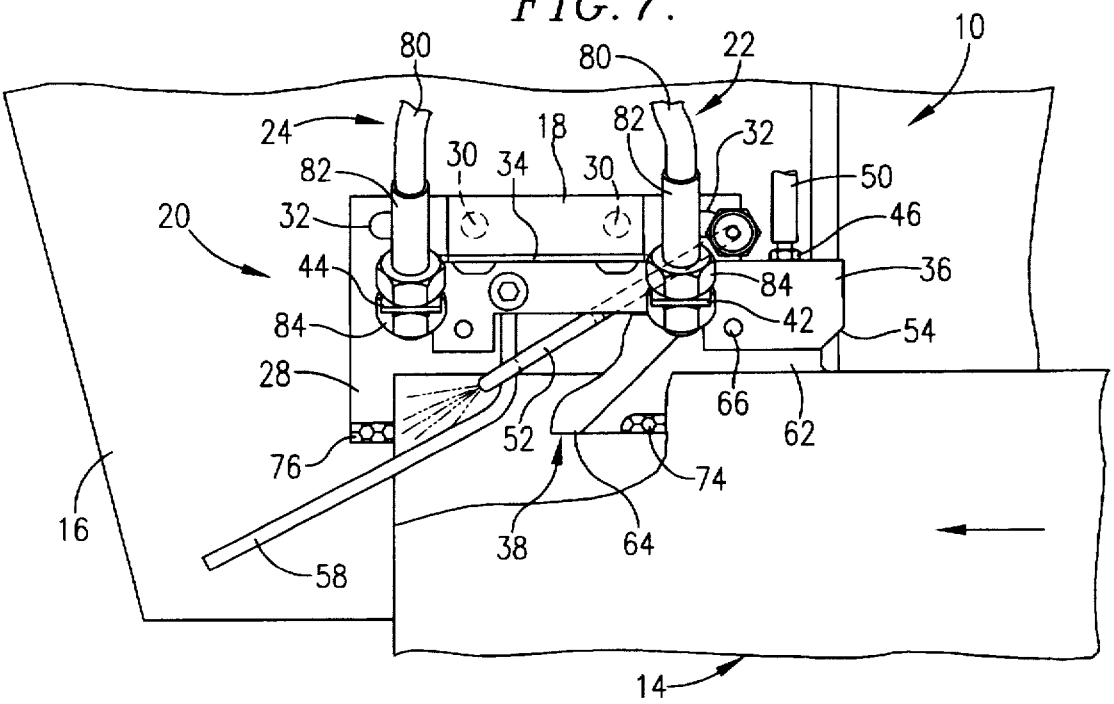

SPEAR MISSED OPEN DETECTION SYSTEM

BACKGROUND OF THE INVENTION

1. Field of the Invention

The present invention relates generally to the art of sheet material associating, and more particularly to an apparatus for opening a publication that is formed of a plurality of sheets and for sensing the open or closed condition of the publication.

2. Discussion of the Prior Art

Newspaper sections and advertising tabloids generally consist of a plurality of flat, identically-sized sheets of paper, wherein the sheets are folded within the next contiguous sheet such that a common centerfold is produced. However, often additional pages, flyers or other materials must be inserted within the section subsequent to the original assembly of the section. In some cases, not all of the sheets intended to be placed within the section are printed at the same time. In other cases, advertising flyers and smaller inserts are printed at a different location and must be placed within the section as soon as the latter is printed. In the past, these inserts have typically been stuffed into a newspaper section by hand. However, this operation is troublesome, labor intensive and time-consuming, causing the price of the final product to increase accordingly.

One apparatus that overcomes many of these problems is disclosed in U.S. Pat. No. 3,561,751, to Dutro, the disclosure of which is incorporated herein by this express reference. The apparatus illustrated in the Dutro patent includes an opener wheel that is positioned along a conventional publication transport device for opening each publication as it passes the opener wheel. More specifically, the opener wheel includes a perforated peripheral surface and a means for drawing a vacuum at timed intervals through the perforations to lift an upper section of the sheets relative to the underlying lower section of sheets. Thereafter, the vacuum is relieved and the upper section drops onto a shelf that maintains the publication open so that additional pages, sections or other materials may be readily inserted within the opened section, either by hand or by conventional automatic insertion equipment.

OBJECTS AND SUMMARY OF THE INVENTION

Although the conventional opening apparatus works well with many types of publications, there are other types of publications with which the known apparatus does not work so well. Accordingly, it is an object of the present invention to provide an opening apparatus that is capable of working either in combination with a conventional opening apparatus or independently to facilitate reliable opening of all types of publications.

It is another object of the present invention to provide an apparatus for opening the publication and for sensing the open or closed condition of the publication so that it is possible to provide an indication that a publication has not been properly opened to receive an insert, and to permit control of automatic insertion equipment downstream of the apparatus in response to the detected condition of each publication.

It is another object of the present invention to provide an apparatus capable of detecting the presence or absence of both sections of an opened publication, wherein detection of the sections is possible even with publications formed of relatively glossy, reflective sheet material.

In accordance with these and other objects evident from the following description of a preferred embodiment of the invention, an apparatus is provided for opening a publication that is formed of a plurality of sheets and for sensing the open or closed condition of the publication. The apparatus includes an opening means for opening the publication into two sections that remain separated from one another during passage through the apparatus, a first detector assembly for sensing the presence of one of the sections at a first predetermined location, and a second detector assembly for sensing the presence of the remaining section at a second predetermined location spaced from the first location. An indicating means is responsive to the first and second detector assemblies for indicating that the opening means properly opened the publication when the sections are sensed at both the first and second predetermined locations, and for indicating that the opening means missed opening the publication when the sections are sensed at only one of the first and second predetermined locations.

By providing an apparatus in accordance with the present invention, numerous advantages are realized. For example, by providing detector assemblies for sensing the presence or absence of the two sections of an opened publication, it is possible to verify proper operation of the opening means. Thus, it is possible to control automatic insertion equipment located downstream of the opening means so that inserts are only placed in properly opened publications. Further, the transport apparatus that is used to convey the publications through the opener and inserter can be controlled to remove unopened publications from the line so that they can be fed through again if desired, and are not delivered from the line without an insert.

A detection apparatus constructed in accordance with the invention includes a piece of reflective tape that is secured to a surface at a predetermined location, wherein the tape is generally parallel to the reference plane. A light emitting means is provided for emitting light, as is a light sensing means for sensing light. The apparatus also includes a directing means for directing the emitted light onto the tape along a predetermined line that intersects the reference plane at an angle of between about 15°–45° and for directing light reflected from the tape along the predetermined line back to the light sensing means. An indicating means indicates the absence of an article at the predetermined location when light is both emitted by the emitting means and sensed by the sensing means, and for indicating the presence of an article at the predetermined location when light is emitted by the emitting means but not sensed by the sensing means.

By providing a detection apparatus in accordance with the invention, numerous advantages are obtained. For example, in handling publications formed of glossy, highly reflective paper stock, there is a possibility that the glossy stock will reflect light directly back at a conventional photoelectric sensor positioned immediately over the travel path of the publications. Such unwanted reflection can cause the sensor to provide a false indication of the absence of an article when in fact the article is properly positioned. However, by providing a detection apparatus in which the light directing means of the detector is angled relative to both the article and the underlying piece of tape, it is possible to accurately sense the presence of any type of paper stock covering the tape, including extremely glossy, reflective stock.

In accordance with the present invention, an apparatus for opening a publication includes a spear, a support means for supporting the spear at a fixed height relative to the publication along the travel path of the publication, and a blowing means for directing air under pressure across the spear toward the publication in a direction generally opposite to and angled relative to the travel path so that the sheets are separated from one another immediately upstream of the spear to facilitate opening of the publication by the spear. An adjustment means adjusts the fixed height of the spear in a direction perpendicular to the line of travel to adjust the point at which the spear enters the publication for controlling the number of sheets in each section.

By providing an opening apparatus in accordance with the invention, several advantages are realized. For example, by combining the use of a spear and a blowing means for directing air under pressure across the spear, it is possible to lift and separate the sheets of the publication to facilitate opening of the publication by the spear. By allowing adjustment of the height of the spear relative to the publication, it is possible to open the publications at or near the center of thereof, regardless of the thickness of the publication. The opening apparatus may be used either individually or in combination with a conventional opener wheel in order to reliably open publications so that inserts may be positioned therein.

BRIEF DESCRIPTION OF THE DRAWING FIGURES

The preferred embodiment of the present invention is described in detail below with reference to the attached drawing figures, wherein:

FIG. 1 is a side elevational view of an apparatus constructed in accordance with the preferred embodiment for opening a publication and for sensing the open or closed condition of the publication;

FIG. 2 is a top plan view of the apparatus, illustrating a separation shelf forming a part of the apparatus;

FIG. 3 is a sectional view of the apparatus taken along line 3—3 of FIG. 1;

FIG. 6 is a top plan view of the apparatus, illustrating a publication being opened;

FIG. 7 is a top plan view of the apparatus with various parts broken away to illustrate an open publication positioned in the apparatus.

DETAILED DESCRIPTION OF THE PREFERRED EMBODIMENT

Figure 4:
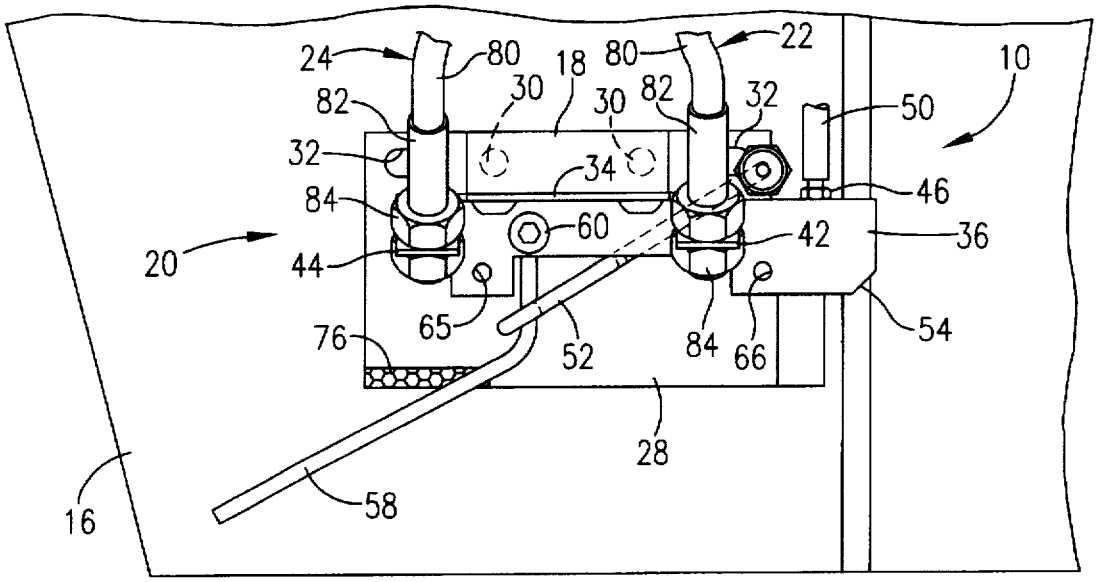
FIG. 4 is a top plan view of the apparatus with the separation shelf removed.

As illustrated in FIG. 1, a detection apparatus 10 is provided for opening a publication and for sensing the open or closed condition of the publication. The apparatus generally overlies a transport device 12 of the type illustrated in, for example, U.S. Pat. No. 3,656,738, to Glaser et al., the disclosure of which is incorporated herein by this reference. However, the utility of the apparatus is not dependent on the type of transport device used, and it may be employed on any other type of transport device desired.

Although not shown, it is possible to employ the detection apparatus of the present invention between a conventional opener wheel and any type of manual or automatic insertion equipment, or to use the inventive apparatus in place of any other opening mechanism. An example of a conventional opener wheel with which the apparatus may be employed is illustrated in U.S. Pat. No. 3,561,751, described above. It is understood that the preferred embodiment may easily be adapted for use in any of these environments without significant change from the construction illustrated in the attached drawing figures.

The detection apparatus 10 broadly includes a table extension 16 that may or may not form a part of the transport device, a base 18 supported on the table extension, a spear assembly 20 secured to the base, and a pair of detection assemblies 22, 24 supported by the spear assembly. The table extension 16 extends along the transport device 12 and defines a support surface for at least partially supporting publications as they are transported along a line of travel over and parallel to the extension. A back plate 26 is secured to the table extension along a rear edge of the extension remote from a curb forming a part of the transport device, and shields the area beyond the apparatus from exposure to publications traveling over the table extension. If desired, the table extension can be made adjustable along the travel path in order to permit positioning of the table extension and of the detection apparatus relative to the upstream and downstream equipment.

As shown in FIG. 3, the base 18 is formed of an upstanding block of steel or other suitable metal and includes the base itself and a bed or bottom plate 28 that is secured to the bottom of the base by a pair of fasteners extending into bores 30, illustrated in FIG. 2. The bottom plate 28 includes a rear edge flush with the rear surface of the base and protrudes forward of the base to define an upper support surface above which each publication travels as it is transported past the apparatus. As shown in FIG. 4, the bottom plate includes a pair of elongated slots 32 by which the base is secured to the table extension by suitable fasteners. The slots permit the position of the detection apparatus to be adjusted along the travel path relative to the table extension. Although not shown, several pairs of holes are preferably provided in the table extension for receiving the fasteners that extend through the slots of the bottom plate, and each pair of holes is spaced from adjacent pairs in a direction generally transverse to the line of travel defined by the transport device. By providing this construction, it is possible to adjust the position of the base in a direction transverse to the travel path in order to accommodate publications of different dimensions.

The spear assembly 20 is shown in FIG. 3, and includes a mounting plate 34, a support block 36, and a separation shelf 38. As shown in FIG. 1, the mounting plate 34 includes a pair of spaced, vertically extending slots 40 through which fasteners extend for securing the mounting plate on the base 18. The slots allow the vertical position of the spear assembly 20 to be adjusted relative to the base so that the distance separating the shelf 38 from the bottom plate 28 of the base may be varied to accommodate publications of different thicknesses.

As shown in FIG. 2, the mounting plate 34 is generally planer, but includes a pair of ears 42, 44 that protrude forward from the support plate at an angle of 15°–45°, and preferably 30°–45°. Each ear includes a hole within which an end piece of one of the detection assemblies is supported, as described below. In addition, although not shown, holes are formed through the mounting plate immediately beneath the ears, and countersunk fasteners extend through the holes for securing the support block 36 to the mounting plate.

Figure 5:
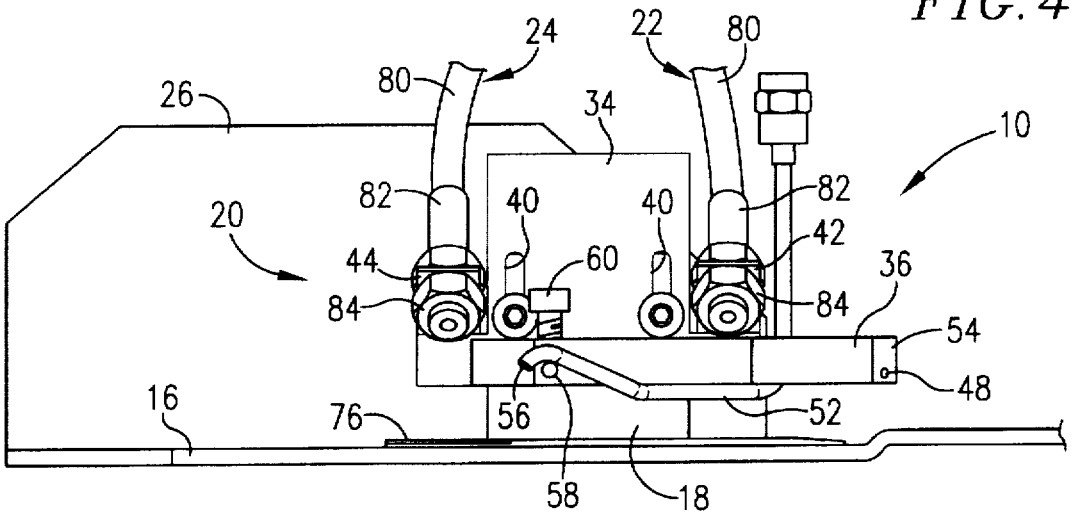
FIG. 5 is a side elevational view of the apparatus with the separation shelf removed.

With reference to FIG. 4, the support block 36 extends over the bottom plate 28 along the length of the base 18, and includes a pair of vertically extending openings 65, 66 which permit the separation shelf to be secured in place on the assembly. An air passageway is formed in the block and extends between an inlet fitting 46 and an outlet orifice 48, shown in FIG. 5. Returning to FIG. 4, the inlet fitting is connected to a first conduit 50 through which air under pressure is supplied to the air passageway. The outlet orifice is formed in an angled face 54 of the block adjacent the upstream end of the separation shelf. As described below, and as shown in FIG. 6, air under pressure is directed through the passageway and from the outlet orifice to facilitate opening of a publication as the publication is engaged by the upstream end of the separation shelf 38.

The apparatus includes a second conduit 52 for supplying air under pressure to the space defined between the bottom plate 28 and the separation shelf 38. As shown in FIG. 3, the second conduit 52 includes a vertical section extending along the rear of the mounting plate and a horizontal section extending beneath the support block and separation plate to an outlet orifice 56 that is directed downward onto the bottom plate. As described below, and as shown in FIG. 7, air under pressure is directed through the second conduit 52 toward the bottom plate in order to hold the sheets of a publication down against the bottom plate as the publication is transported through the apparatus. Additional conduits may be provided for directing air under pressure down onto the publication at other points along the apparatus to hold the sheets of the publication down against the separation shelf to prevent the sheets from flying up or lifting off of the remaining sheets.

An opening arm 58 extends laterally from the support block 36 in a direction that is angled relative to the line of travel of the publications. The opening arm is adapted to support the upper section of a publication upon opening as the publication is transported to a downstream insertion mechanism. As shown in FIG. 4, a vertical hole is provided in the base in communication with the hole within which the opening arm 58 is supported, and a threaded fastener 60 is provided in the vertical hole for securing the arm to the block. The arm 58 extends beneath and supports the second conduit 52, holding the conduit up against the underside of the separation shelf out of the way of publications being transported through the apparatus.

Returning to FIG. 1, the separation shelf 38 is formed of a metal plate, and includes an upstream section 62 that is generally parallel to the bottom plate of the base, and a downstream section 64 that is angled upward away from the bottom plate of the base. As shown in FIG. 2, the upstream section 62 extends beneath the support block 36 and is secured to the block by a suitable fastener extending through the hole 66. The downstream section includes a longitudinally extending tab 68 that extends over the support block and is secured in place by another fastener 70. Thus, the separation shelf 38, support block 36, and mounting plate 34 are all secured together and move as a unit when the vertical position of the mounting plate is adjusted relative to the base 18.

The upstream section 62 of the separation shelf 38 presents an upstream end defining a spear 72 having a triangular shape and presenting a tip having a sharpened edge adapted to pierce each publication as the publication is transported through the apparatus. The spear includes a first edge collinear with the front edge of the separation plate 38 and parallel with the travel path defined by the publications, and a rear edge that is angled downstream away from the first edge toward the support block 36. The angled face 54 of the block forms an acute angle with the rear edge of the spear 72 and the outlet orifice 48 is directed toward the sharpened tip so that air under pressure is directed toward and across the tip. The outlet orifice is located at the same height as the spear so that air directed under pressure from the outlet orifice is discharged toward the tip of the spear. In addition, as shown in FIG. 6, the outlet orifice directs the air in a direction generally opposite to the direction of travel of the publications, and angled relative to the travel path so that the air penetrates the publication at the leading corner to lift and separate the sheets from one another adjacent the spear. Although not shown, a guide bar or the like can be positioned over the spear to prevent the leading corners of the sheets from blowing back from the remaining sheets as the publication is opened by the spear.

A first piece of reflective tape 74 is provided on the upper surface of the separation shelf along a portion of the front edge of the upstream section 62. The reflective tape is unique in that it is capable of reflecting light back in the direction from which the light is emitted even when the light is directed at an angle of as little as 15° or less relative to the plane defined by the tape. A preferred tape is available commercially from the Minnesota Mining and Manufacturing Company, and is capable of reflecting light back in the direction from which it is emitted, even when the light is directed at an angle of as little as 3°–5°. As shown in FIG. 4, a second piece of reflective tape 76 similar to the first is secured to the upper surface of the bottom plate 28 at a predetermined location spaced longitudinally downstream from the first piece 74. As illustrated in FIG. 2, the first and second pieces of tape define first and second predetermined locations along the travel path at which the presence or absence of a publication is sensed in order to provide an indication as to whether the publication has been properly opened prior to being transported to a downstream insertion operation.

Returning again to FIG. 1, each detection assembly 22, 24 generally includes a controller 78 that is mounted remote from the apparatus on a suitable frame element accessible to the operator, and a bundle 80 of optical fibers connected to the controller for directing light to and from the controller. An end piece 82 is provided on the optical fiber bundle by which the bundle is supported on the mounting plate 34 of the spear assembly 20. As shown in FIG. 4, the end piece 82 includes a tubular, threaded conduit within which the bundle is received and a pair of nuts 84 that are received on the conduit for securing it in place in the hole of one of the ears. One or more lenses may also be provided within the end piece for focusing light that is directed through the fibers.

With reference to FIG. 2, the end piece 82 of the upstream detection assembly 22 is supported by the upstream ear 42 of the mounting plate 34 and directs light to and from the first piece of reflective tape 74 on the upper surface of the separation shelf 38. The end piece 82 of the downstream detection assembly 24 is supported by the downstream ear 44 of the mounting plate and directs light to and from the second piece of reflective tape 76 on the upper surface of the bottom plate 28 of the base 18. As shown in FIG. 1, the downstream section 64 of the separation shelf 38 is angled upward relative to the upstream section by an angle sufficient to expose the downstream piece of tape 76 to the downstream detection assembly 24. Thus, a clear line of sight exists between each piece of reflective tape and the corresponding detection assembly.

The controller 78 of each detection assembly is conventional, and includes a light emitting means for emitting light that is directed along selected fibers of the bundle 80 onto the corresponding piece of reflective tape. In addition, the controller includes a sensing means for sensing light that is reflected back toward the end piece of the assembly and directed through other selected fibers of the bundle to the controller. An indicating means 86 forms a part of each detection assembly for indicating the absence of an object at the predetermined location when light is both emitted by the emitting means and sensed by the sensing means, and for indicating the presence of an object at the predetermined location when light is emitted by the emitting means but not sensed by the sensing means. Preferably, the indicating means includes visual indicators, but audible indicators could also be provided. Further, it is possible to replace the indicating means with a control means for controlling downstream operations based on the sensed condition of each publication transported through the detection apparatus.

Figure 8:
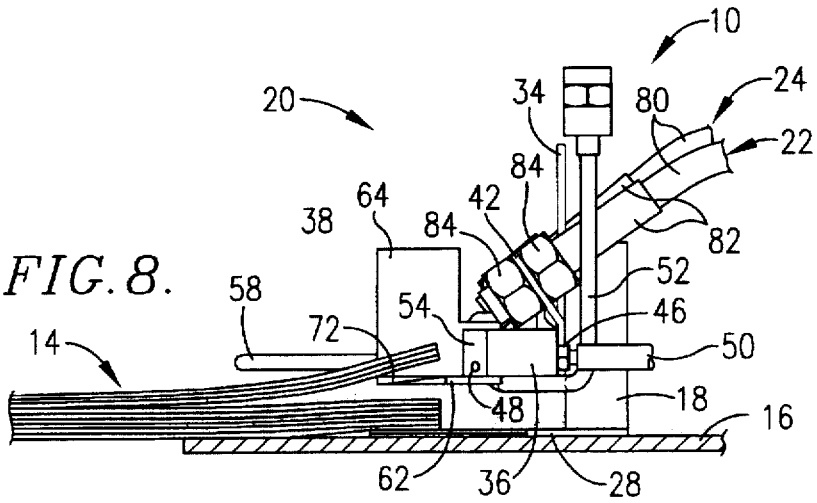
FIG. 8 is a front end elevational view of the apparatus, illustrating an open publication positioned in the apparatus.

The end pieces 82 of the detection assemblies 22, 24 are spaced vertically from the pieces of reflective tape 74, 76 in order to accommodate publications of various thicknesses. In addition, as shown in FIG. 8, the end pieces are disposed at an angle of 15°–45°, and preferably at an angle of 30°–45° relative to the planes within which the two pieces of tape are disposed so that when publications formed of glossy, reflective paper stock are disposed over the pieces of tape, light from the detection assemblies is not reflected back toward the assemblies, but rather is reflected away from the end pieces. Thus, an accurate indication is given as to the presence or absence of the publication over the pieces of tape. If the angle of each end piece is too low relative to the plane defined by the corresponding piece of tape, the apparatus will not accommodate thick publications that extend above the end pieces. If the angle of each end piece is too high relative to the plane defined by the corresponding piece of tape, the chances increase that glossy, reflective paper stock will reflect light from the detection assemblies back to the assemblies, resulting in an incorrect indication of the absence of the publication over the tape. The noted angular range of 15°–45° avoids these problems, and optimum performance is achieved with a range of 30°–45°.

In operation, each publication is successively fed to the transport device, engaging the bed of the device and sliding downward until the centerfold or binding of the publication contacts a curb running along the lower front edge of the device. Thereafter, each publication is conveyed along the transport device, following a travel path that brings the upper edge of the publication opposite the centerfold through the apparatus 10.

As a publication continues its forward travel, the leading corner of the publication 14 remote from the centerfold approaches the opener wheel when such opener wheel is employed. The opener wheel rotates in timed relationship to the advancement of the publication so that when a vacuum is drawn through the perforations, the opener wheel lifts the leading corner, opening the publication and dividing it into two sections. Thereafter, the vacuum pressure is relieved, and the upper section is released from the opener wheel. At this time, however, the upper section is positioned over the upstream section of the separation shelf 38 and thus drops onto the shelf.

Where the apparatus is employed independently of the opener wheel, opening of each publication is achieved solely by the opening means defined by the spear assembly 20. Thus, as a publication is conveyed toward the apparatus, as shown in FIG. 6, the leading corner of the publication remote from the centerfold approaches the spear 72 and air from the outlet orifice 48 is directed under pressure toward the leading corner of the publication, causing the sheets to lift and separate from one another, although not to the exaggerated degree shown. The height of the spear and the outlet orifice may be adjusted relative to the travel path to adjust the point on the publication at which the spear separates the sheets, thus allowing the spear to be set at a height that opens the publication at or near the center, regardless of the thickness of the publication.

As the publication continues to advance, as shown in FIG. 8, the upper section of the publication slides along the top of the separation shelf 38 while the remaining sheets slide therebeneath along the bed or bottom plate 28. As such, the sheets of the upper section cover the first piece of tape 74, blocking the line of sight between the tape and the end piece 82 of the upstream detection assembly 22. Thereafter, light emitted by the detection assembly 22 and directed onto the tape through the end piece 82 is reflected away from the end piece rather than back toward it as is the case when the line of sight between the end piece and the tape is unobstructed. When this condition is sensed by the detector, the indicating means 86 is activated, providing an indication that the upper section of the publication is present on the separation shelf.

As the publication continues to advance, as shown in FIG. 7, the lower section slides along the bottom plate 28 of the base beneath the separation shelf. As such, the sheets of the lower section cover the second piece of tape 76 on the upper surface of the bottom plate, blocking the line of sight between the tape and the end piece of the downstream detection assembly 24. Thereafter, light emitted by the detection assembly and directed onto the tape through the end piece is reflected away from the end piece rather than back toward it. When this condition is sensed by the second assembly 24, the indicating means is activated, providing an indication that the lower section of the publication is present on the separation shelf. If both the upper and lower sections of the publication are sensed by the detectors, confirmation is provided that the publication has been properly opened and is prepared for receipt of an insert.

As the lower section of the publication slides across the bottom plate over the second piece of tape, the upper section slides across the downstream section 64 of the shelf which, by virtue of its inclined configuration, raises the upper section higher. This prevents the upper section from obstructing the line of sight between the second piece of tape 76 and the end piece 82 of the downstream detection assembly 24. At the same time, the opening arm 58 engages the upper section so that the upper section of the publication is at a position sufficiently open and away from the remaining sheets of the section to permit additional sheets of paper to readily be inserted within the opened publication between the upper section and the lower, remaining sheets below. As the publication continues to advance along the downstream portion, automatic supply means (not shown) inserts additional sheets of paper or other materials into the opened section between the separation shelf and the lower section of the publication sliding along the bed. Alternatively, the additional insert sections can be fed by hand if desired.

If the detection assemblies fail to confirm that a publication has been properly opened, it is possible, in addition to providing a visual or audible indication, to control operation of the transport device or of automatic inserting equipment so that the publication is not delivered from the line without an insert. For example, in response to the sensed, closed condition of a publication, the publication could be removed from or redirected by the transport device so that it would be reconveyed through the apparatus and would receive an insert. Likewise, other means could be employed for insuring that only properly opened publications are advanced to the automatic inserting device.

Although the present invention has been described with reference to the preferred embodiment, it is noted that equivalents may be employed and substitution made herein without departing from the scope of the invention as recited in the claims.

What is claimed is:

1. An apparatus for opening a publication that is formed of a plurality of sheets and for sensing the open or closed condition of the publication, the apparatus comprising:

an opening means for opening the publication into two sections that remain separated from one another during passage through the apparatus;

a first detector assembly for sensing the presence of one of the sections at a first predetermined location;

a second detector assembly for sensing the presence of the remaining section at a second predetermined location spaced from the first location; and indicating means responsive to the first and second detector assemblies for indicating that the opening means properly opened the publication when the sections are sensed at both the first and second predetermined locations, and for indicating that the opening means missed opening the publication when the sections are sensed at only one of the first and second predetermined locations.

2. An apparatus as recited in claim 1, wherein the opening means includes:

a spear for piercing the publication, separating the sheets into two sections;

a support means for supporting the spear at a fixed height relative to the publication along the travel path;

a blowing means for directing air under pressure across the spear toward the publication in a direction angled relative to the travel path to separate the sheets from one another immediately upstream of the spear to facilitate piercing of the publication by the spear; and an adjustment means for adjusting the fixed height of the spear in a direction perpendicular to the line of travel to adjust the point at which the spear pierces the publication for controlling the number of sheets in each section.

3. An apparatus as recited in claim 1, further comprising a piece of reflective tape secured in place at each of the first and second predetermined locations, each piece of tape being generally planer, defining a reference plane, wherein each detector assembly includes a light emitting means for emitting light, a light sensing means for sensing light, and a directing means for directing the emitted light onto the tape along a predetermined line that intersects the reference plane at an angle of between about 15°–45° and for directing light reflected from the tape along the predetermined line back to the light sensing means, the indicating means indicating the absence of an article at the predetermined location when light is both emitted by the emitting means and sensed by the sensing means, and indicating the presence of an article at the predetermined location when light is emitted by the emitting means but not sensed by the sensing means.

4. An apparatus as recited in claim 2, further comprising a piece of reflective tape secured in place at each of the first and second predetermined locations, each piece of tape being generally planer, defining a reference plane, wherein each detector assembly includes a light emitting means for emitting light, a light sensing means for sensing light, and a directing means for directing the emitted light onto the tape along a predetermined line that intersects the reference plane at an angle of between about 15°–45° and for directing light reflected from the tape along the predetermined line back to the light sensing means, the indicating means indicating the absence of an article at the predetermined location when light is both emitted by the emitting means and sensed by the sensing means, and indicating the presence of an article at the predetermined location when light is emitted by the emitting means but not sensed by the sensing means.

5. An apparatus for detecting the presence and absence of an article at a predetermined location, comprising:

a planer surface presenting the predetermined location and defining a reference plane at the predetermined location;

a piece of reflective tape secured to the surface at the predetermined location, the tape being generally parallel to the reference plane;

a light emitting means for emitting light;

a light sensing means for sensing light;

a directing means for directing the emitted light onto the tape along a predetermined line that intersects the reference plane at an angle of between about 15°–45° and for directing light reflected from the tape along the predetermined line back to the light sensing means; and an indicating means for indicating the absence of an article at the predetermined location when light is both emitted by the emitting means and sensed by the sensing means, and for indicating the presence of an article at the predetermined location when light is emitted by the emitting means but not sensed by the sensing means.

6. An apparatus as recited in claim 5, wherein the directing means includes a bundle of optical fibers, wherein some of the fibers in the bundle direct the emitted light onto the tape along the predetermined line, and others of the fibers direct light reflected from the tape along the predetermined line back to the light sensing means.

7. An apparatus as recited in claim 6, further including a mounting means for mounting the optical fiber bundle on the apparatus in an orientation angled relative to the reference plane by an angle of 15°–45°.

* * * * *